US008065766B1

(12) United States Patent
Fierro

(10) Patent No.: US 8,065,766 B1
(45) Date of Patent: Nov. 29, 2011

(54) SIDE SLEEPER PILLOW

(76) Inventor: Randolph Brian Fierro, Flower Mound, TX (US)

( * ) Notice: Subject to any disclaimer, the term of this patent is extended or adjusted under 35 U.S.C. 154(b) by 0 days.

(21) Appl. No.: 12/380,420

(22) Filed: Feb. 27, 2009

Related U.S. Application Data

(60) Provisional application No. 61/067,536, filed on Feb. 28, 2008.

(51) Int. Cl.
*A47G 9/00* (2006.01)

(52) U.S. Cl. ..... 5/632; 5/630

(58) Field of Classification Search ..... 5/632–633, 5/630, 652, 636
See application file for complete search history.

(56) References Cited

U.S. PATENT DOCUMENTS 3,939,508 A * 2/1976 Hall et al. ..... 5/727
4,853,993 A * 8/1989 Walpin et al. ..... 5/634
4,970,742 A * 11/1990 Keener ..... 5/633
5,581,831 A * 12/1996 Xiang ..... 5/636

* cited by examiner

*Primary Examiner* — Fredrick Conley
(74) *Attorney, Agent, or Firm* — Jeffrey Roddy

(57) ABSTRACT

A pillow for side-sleeping providing support of the shoulder and lumbar regions and thereby increasing comfort, where the pillow is constructed of tiers of foam, with each foam layer laminated to an adjacent foam layer and where the foam layers vary in thickness and density producing compression zones. The pillow has a raised area that is placed under the axilla, while the remaining portion of the pillow is placed under the upper ribcage. The pillow may be used as a therapeutic adjunct to a conventional fiber-filled pillow placed under the head and neck, or as a therapeutic adjunct to a specialty pillow, such as a cervical pillow.

19 Claims, 7 Drawing Sheets

SIDE SLEEPER PILLOW

CROSS REFERENCE TO RELATED APPLICATIONS

This application claims the benefit of Provisional Patent Application No. 61/067,536 filed Feb. 28, 2008

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

Restful sleep being important for the maintenance of good health is facilitated by proper sleeping posture. Most individuals sleep on their side ("side sleepers") rather than their back or stomach. Frequently side sleepers experience discomfort in the neck, shoulder, arm, back and hips, any of which can lead to tossing and turning and misalignment of the spine which in turn interferes with proper sleep posture and prevents restful sleep. It is well known that overly tired individuals may fall asleep and assume a misaligned spinal position for extended periods aggravating musculoskeletal pain and producing an undesirable cycle of pain and insomnia.

Many pillow-type support devices have been devised to address musculoskeletal pain. Some of these are designed to assist the user in maintaining a healthful posture; some are designed for the waking hours, as for example when sitting or standing, while others are designed to cradle or restrict the movement of a sleeper while in a supine or side laying position.

Currently, specialty pillows (e.g. cervical support pillows and orthopedic pillows) designed as sleep aids fall into three basic categories: wedge pillows, body pillows and multi-part pillows. The most prevalent of the wedge pillows are the so called cervical pillows comprising a contoured body constructed of foam which is placed under the user's head and neck. While stabilization of the cervical spine has obvious advantages, and may help with neck and shoulder pain, claims that these devices may assist with lower lumbar pain are questionable because they do not inhibit the user from twisting the lumbar-thoracic region during sleep. Additionally, many of these cervical pillows are constructed solely of so-called memory foam (MF), which while suitable for neck support, does not provide the resistance necessary to support the shoulder or thoracic region. Because cervical pillows result in no load changes in the shoulder and back region, the spine may still be misaligned.

Body pillows are designed to reside under more than one region, such as U.S. Pat. No. 7,310,840 to Rubio that supports the head, neck, thorax and lumbar regions.

Multi-part pillows are more complex in design and frequently involve detachable sub-units. Although the aforementioned classes of pillow may work well for their intended purpose, none adequately address the needs of the side sleeper: proper spinal alignment and comfort.

Because a side sleeping position is considered helpful for persons desiring to take pressure off the spine, it follows that what is needed is a device that will assist a person in maintaining a side sleeping position by mediating between the lumbar and cervical regions by stabilizing the thoracic region. Such a device would habituate the user to maintaining a healthful sleeping posture by providing optimal support for the lumbar-thoracic region, and over time relieving some of the pain associated with musculoskeletal strain.

An ideal therapeutic support to promote comfortable sleep and posture would have a number of characteristics: It would provide comfort and promote proper alignment of the spinal column, help the sleeper to reduce the frequency of positional changes during sleep due to discomfort, would be useable with a conventional fiber filled head pillow, specialty pillow or any cervical pillow favored by the user without negating the therapeutic effect, and would resist morphological changes due to compression over time.

SUMMARY OF THE INVENTION

The present invention is a side sleeper pillow with multiple compression zones provided by tiered foam layers of varying density designed to help one maintain a restful and therapeutic sleeping position while sleeping on one's side. When positioned under the upper rib cage and axilla, it provides support for the spinal column, while offsetting the weight borne by the shoulder, rotator cuff and arm, and lower back. The overall effect is a reduction of musculoskeletal stress on the cervical spine, down-side shoulder joint and arm, and the lumbar spine. The present invention is directed to the therapeutic relief of pain, especially of the neck, shoulder and lower back. The device works to reduce torsion between the two ends of the spine; the lumbar and cervical regions, by helping to stabilize the thoracic spine and promoting overall alignment of the spinal column. The present invention may be thought of as a jack positioned midway along the frame of an automobile, with the tires being the shoulder and pelvis respectively, and the ground being the mattress; when the car is partially raised by means of the jack, weight is redistributed to the frame and away from the pressure points (tires). Use of the side sleeper pillow reduces weight-bearing in the shoulder region and low back region reducing rotation of the spine and encourages improved alignment of the cervical spine, thoracic spine and lumbar spine. The present invention may be used for right-side sleeping and left-side sleeping. The present invention may be used beneficially in combination with a conventional fiber or down-filled pillow or with a specialty cervical pillow of one's choosing. In a preferred embodiment, the present invention includes a top layer of foam mainly for comfort, a middle layer of foam for support and comfort and a base layer of foam primarily for support.

It is felt that the present invention meets the aforementioned requirements without the shortcomings of previous claimed therapeutic pillow-type devices.

One object of the present invention is to help stabilize the thoracic spine when a user is in a side laying position and by doing so, promote alignment of the lumbar and cervical spine.

Another object of the present invention is as a comfort aid to reduce the frequency positional changes during sleep.

Another object of the present invention is to reduce twisting and rotation of the spine along its axis by helping a body to maintain a comfortable sleeping position.

Another object of the present invention is to offset the load borne by the shoulder, rotator cuff and arm.

Another object of the present invention is to alleviate pressure points on the shoulder, arm, back and neck.

Another object of the present invention is to alleviate pain by helping to correct musculoskeletal misalignment during sleep.

Another object of the present invention is to perform consistently regardless of the firmness of one's mattress.

Yet another object of the present invention is to provide a portable side sleeping aid that may be easily packed for travel.

Still another object of the present invention is to provide a side sleeping aid that may be beneficially used in combination with a user's preferred cervical pillow.

Related benefits are a reduction of spinal "sagging" while in side sleeping position, discouraging rolling to one's back or stomach and the possible reduction of sleep apnea and snoring by promoting the side laying position while sleeping.

Other objects and advantages of the present invention will become apparent from the following descriptions, taken in connection with the accompanying drawings and charts, wherein by way of illustration and example, a preferred embodiment of the present invention is disclosed.

DETAILED DESCRIPTION OF THE INVENTION

Definitions

The terms pillow, or pillow for side sleeping, are used to describe the present invention.

The term pain refers to pain resulting from musculoskeletal strain or vertebral torsion.

FFP refers to a conventional fiber filled pillow designed to rest under a users head and neck.

MF refers to memory foam or visco-elastic foam material.

HR refers to high resiliency.

ILD refers to the indentation load deflection given in pounds which is a measure of how much pressure it takes to compress the foam to 25 percent of its thickness. ILD ratings indicate the firmness of foam.

Density is herein described in lbs/ft$^3$—e.g. a density of 2.5 would be 2.5 lbs per cubic foot of foam material.

The term foam, unless explicitly directed to a particular type, or brand of material may refer to any type of commercially available foam. Polyurethane foam is used in the preferred embodiment, but conceivably, any type of commercially available foam meeting the density requirements is suitable.

Referring generally to FIGS. 1-6; a pillow 10' for side sleeping is shown having multiple tiered layers where each layer is constructed from foam of a particular density. The pillow is 18 to 22 inches in width, and most preferably 20 inches in width. The pillow is preferably 8 to 12 inches in length and most preferably 10 inches in length. The pillow has a first lower end 11" along on lengthwise side that is 1½ inches in overall thickness with a second raised end defining a plateau 14" ranging from 3¼ to 4 inches in overall thickness. The overall thicknesses of ends 11" and 14" depend on the aggregate thicknesses of all combined layers and may vary within the prescribed ranges depending on the body weight and other characteristics of the user. Multiple laminations of foam layers make up both the first lower edge and the opposite raised end. In one embodiment, a variable pressure inflatable bladder may be fitted into a recess formed between foam layers.

Figure 1:
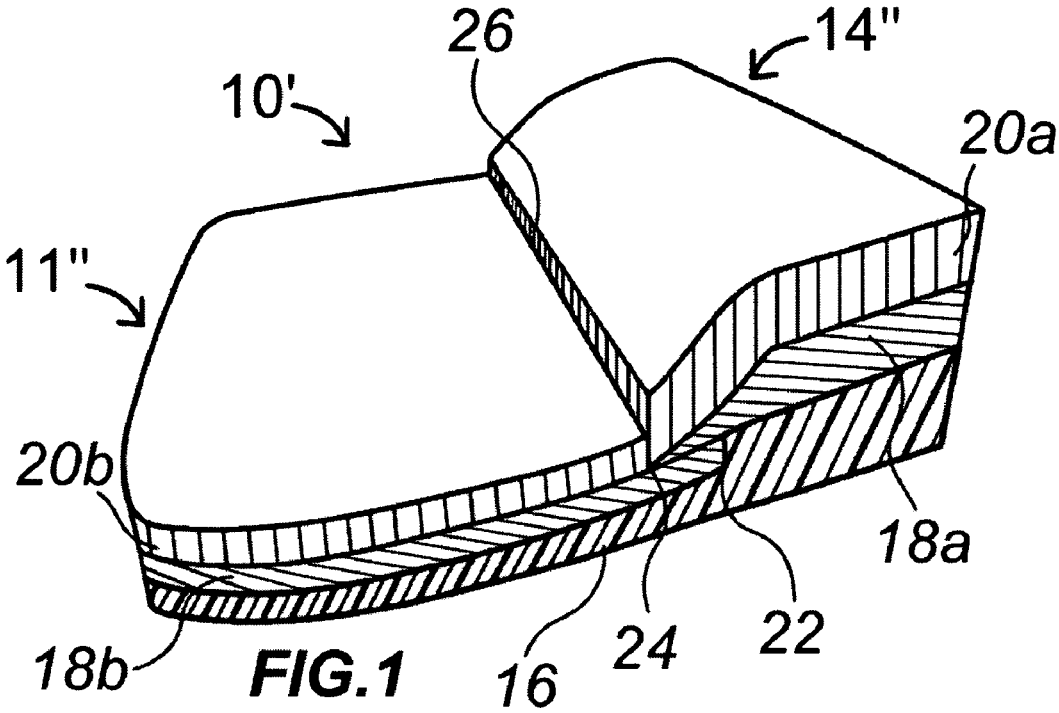
FIG. 1 is a perspective view of a preferred embodiment according to the present invention showing the compression zones.
Figure 2:
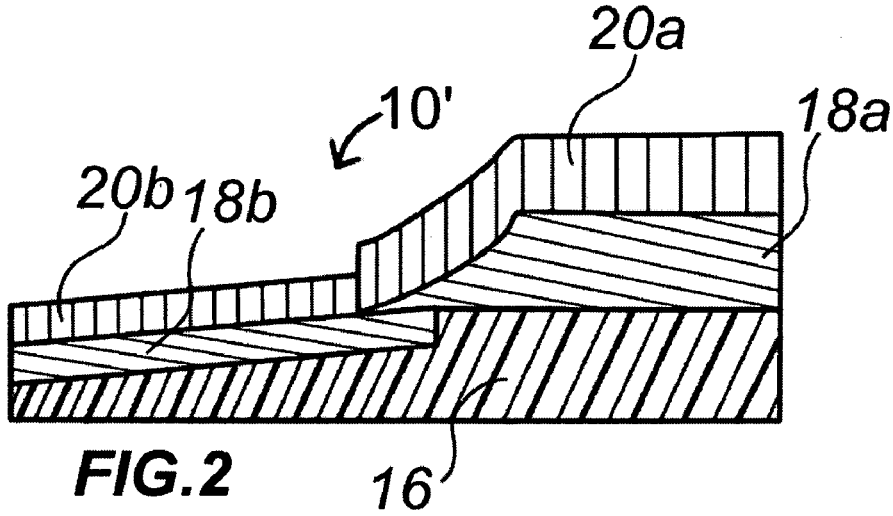
FIG. 2 is a side elevation of the embodiment of FIG. 1, showing the compression zones.

FIG. 1 and FIG. 2 show a preferred embodiment according to the present invention having three tiered laminations of foam. The layers are laminated together using any suitable foam adhesive such as 444 Adhesive Spray from Clearco Products, Bensalem, Pa. FIG. 2 shows a side elevation of the embodiment of FIG. 1, where the pillow 10' is divided lengthwise beginning with a transitional ridge 26 and forms an upward sloping curve from the lower end to the plateau. The top foam layer includes two sections, top foam member **20*a* is 1 inch in thickness at the plateau of the pillow, and is divided at ridge 26. A continuation of the top foam layer, top foam member 20*b* is ½ inch in thickness. Both foam members 20*a* and 20*b* are respectively uniform in thickness throughout. An intermediate foam layer includes two sections, an intermediate foam member 18*a*, which is 1¼ inches within the plateau 14" of the pillow 10' and foam member 18*b* which is ½ inch at the lower end of the pillow. A base foam member 16 preferably of one piece construction, forms the foundation of the pillow 10' and has a thickness ranging from 1 inch to 1¾ inches at the plateau 14", and ½ inch at the lower end 11". While, the intermediate and top foam members are preferably of two piece construction for ease of manufacture when working with foam planks of uniform thickness, conceivably they may each be molded of one piece construction. Together, the three laminated foam layers define three discrete compression zones owing to particular density of foam and ILD rating. Preferably, the top foam members 20***a*,20*b* are visco elastic memory foam (MF), with a density of between 2 lbs and 5.5 lbs, preferably between 2.5 lbs and 3.5 lbs, and most preferably between 2 lbs and 3 lbs. The intermediate foam members 18*a*,18*b* have a density between 1.8 lbs and 3 lbs and most preferably a density between 1.8 lbs and 2.5 lbs. The base foam member 16 has a density between 1.8 lbs and 4 lbs and most preferably between 2.5 lbs and 3 lbs. The base foam member 16 is of relatively higher density so that it distributes the user's weight to the mattress evenly, while the intermediate foam members 18*a*,18*b* are more compressible than the base foam member and provides support for the top foam members 20*a*,20*b* of memory foam.

Figure 3:
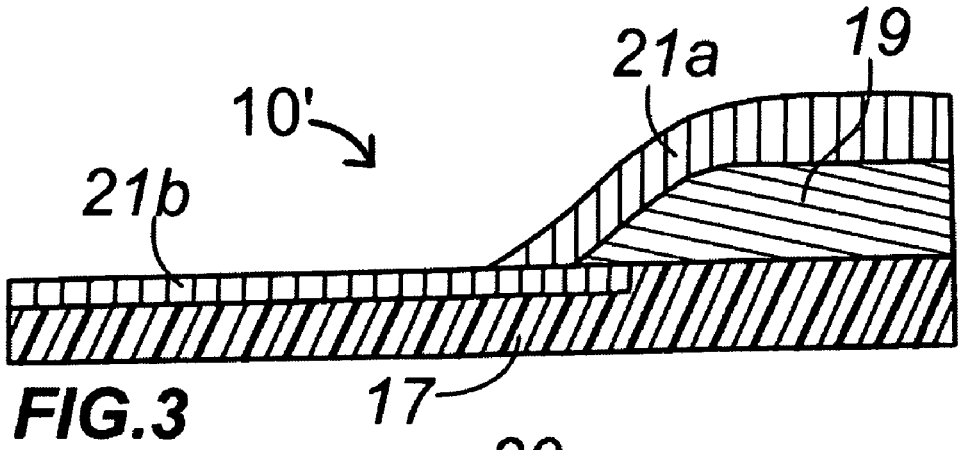
FIG. 3 is a side elevation of another embodiment according to the present invention showing the compression zones.

FIG. 3 is a side elevation of an embodiment utilizing the same densities of foam in FIG. 1, while omitting that portion of the intermediate foam member 18*b*. The overall thickness of the lower portion 11" remains preferably between 1 and 1½ inches in thickness and most preferably between 1 inch and 1¼ inches in thickness. The overall thickness of the plateau 14" is between 3¼ inches and 4 inches in thickness. The layer of top foam member 21*b* is preferably between ½ inch and ¾ inches in thickness at the lower end and between ½ inch and 1 inch in thickness within the plateau. The base foam member 17 is preferably between ½ inch and 1 inch in thickness at the lower end, and preferably between 1 and 1¼ inches in thickness underlying the plateau.

Figure 4:
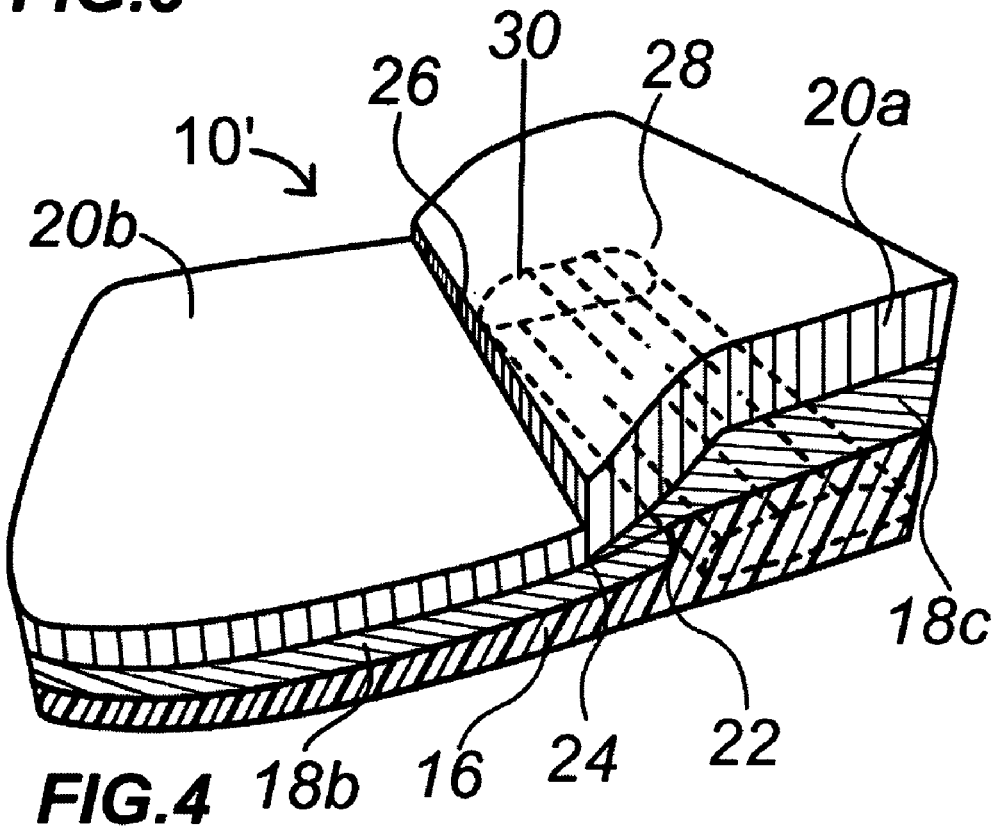
FIG. 4 is a perspective view of another embodiment according to the present invention showing the use of an inflatable filled bladder to raise or lower that end of the pillow residing under the axilla.
Figure 5:
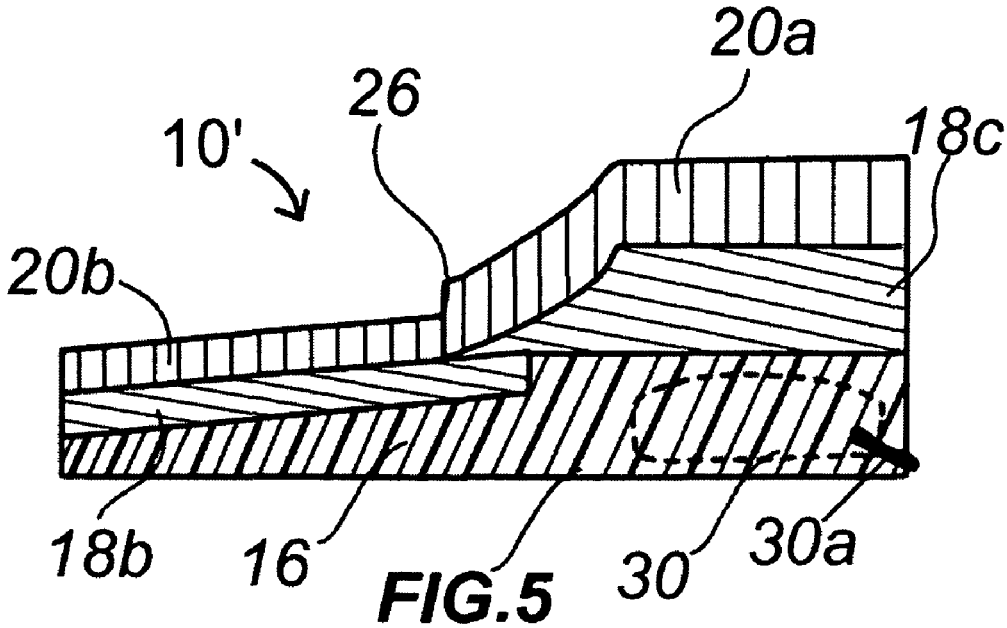
FIG. 5 is a side elevation of the embodiment of FIG. 4.
Figure 6:
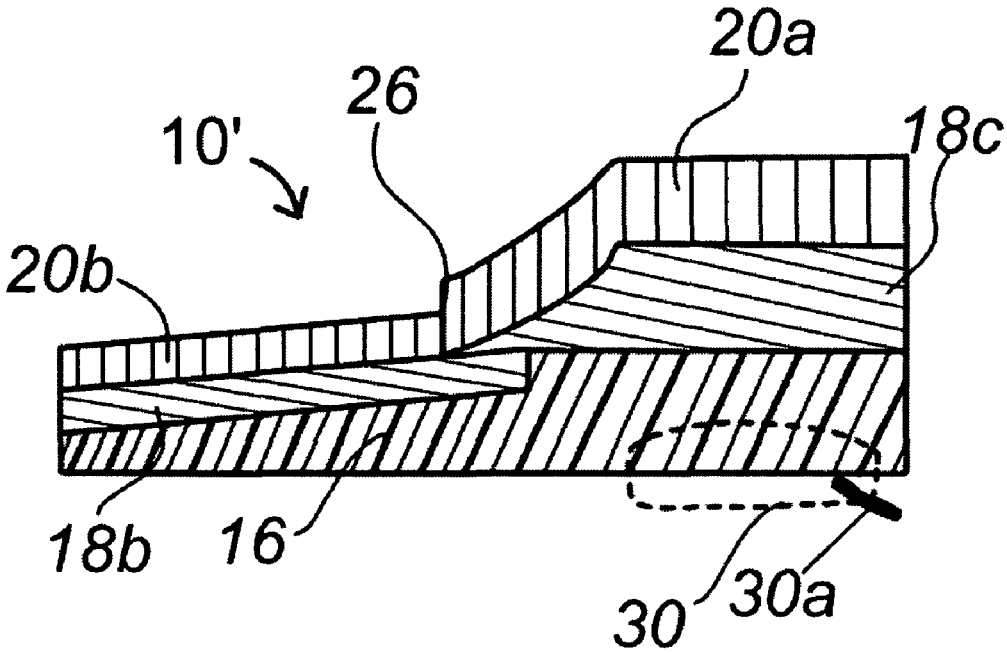
FIG. 6 is a side elevation of the embodiment of FIG. 4 with the inflatable bladder partially extending below the base of the pillow.

FIG. 4 is a perspective view of a another alternate embodiment utilizing the same densities of foam and measurements as the embodiment of FIG. 1, where a cavity 28 has been formed in a portion of the base layer 16 for the reception of an inflatable bladder 30, the inflation or deflation of the bladder is used to adjust the elevation of that part of the pillow 14" meant to reside under the axilla. The bladder may be removable with a plug of foam shaped to fit the cavity 28 substituted. The side elevation FIG. 5, shows a air valve stem 32*a* exiting one end of the pillow so that the bladder may be inflated by "blowing up" or with any hand pump such as a bicycle pump or a small accordion pump typically used for an air mattress. While the working fluid of the bladder is preferably air, conceivably water may also be used. FIG. 6 shows the inflatable bladder 30 placed partially under the base foam layer, where the base foam layer has a shaped indentation to accommodate the bladder. Alternately, the inflatable bladder may be used as an adjunct with the pillow embodiment shown in FIG. 1, and simply placed beneath the bottom layer 16.

Figure 7:
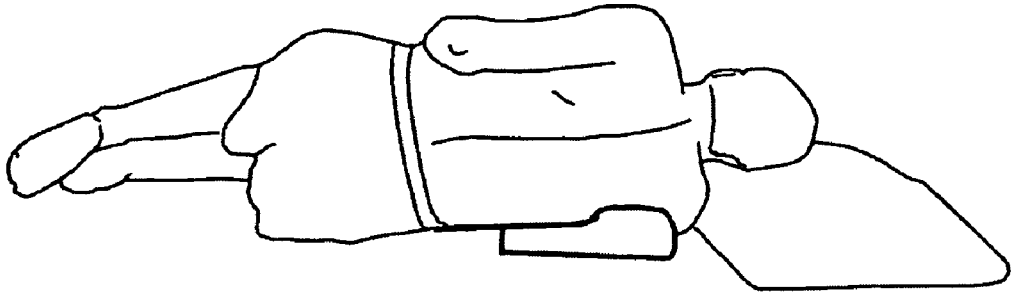
FIG. 7 shows a side elevation of one embodiment according to the present invention in a typical use.
Figure 8:
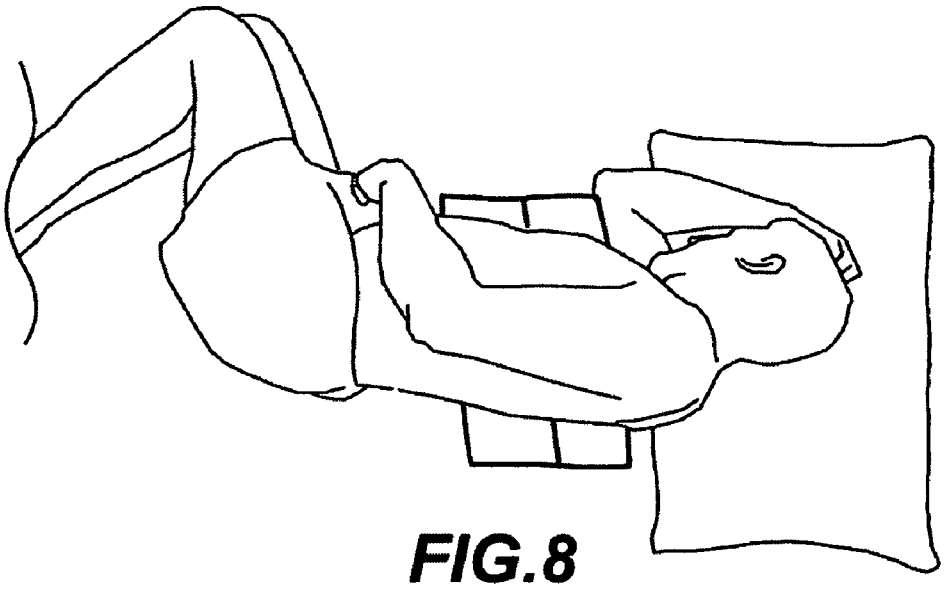
FIG. 8 shows a top down view of one embodiment according to the present invention in a typical use.

FIG. 7 and FIG. 8 show side elevation, and a top down view respectively, of the present invention 10' in what would be a typical use with the lower end 11" positioned under the lower rib cage and the plateau 14" positioned under the axilla. This arrangement helps to stabilize the user in a side laying position while avoiding excess pressure of the lower rib cage.

Figure 9:
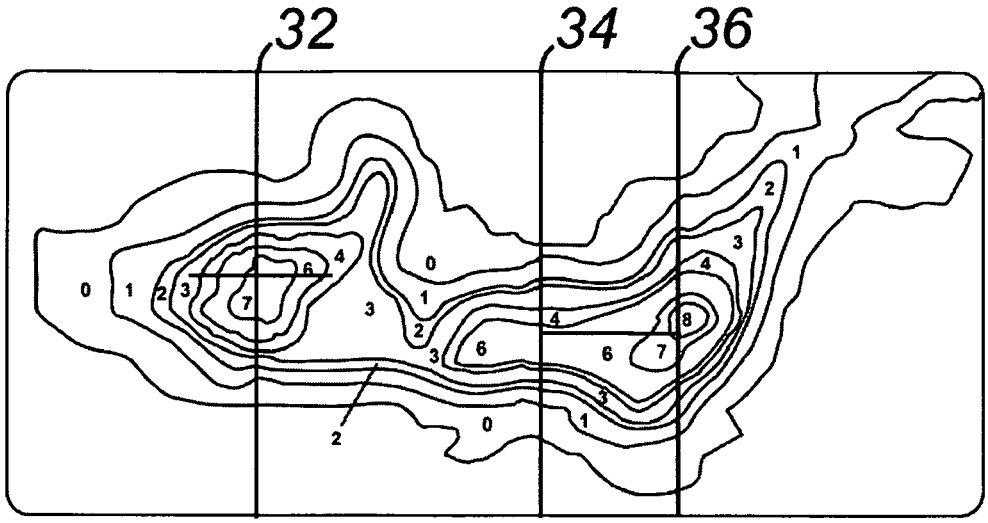
FIG. 9 is a pressure map showing pressure zones produced by a side sleeper using only a conventional fiber filled pillow under their head, where the firmness rating of the mattress is given a rating of 50 (medium)
Figure 10:
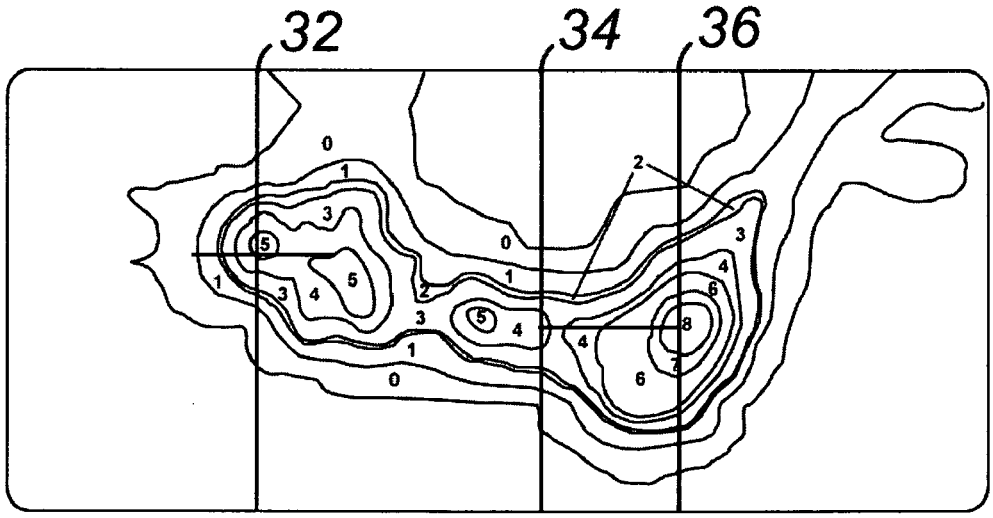
FIG. 10 is a pressure map showing changes in the pressure zones produced by a side sleeper using only a conventional fiber filled pillow under their head and using the present invention in the axilla and upper rib area, where the firmness rating of the mattress is given a rating of 50 (medium)
Figure 11:
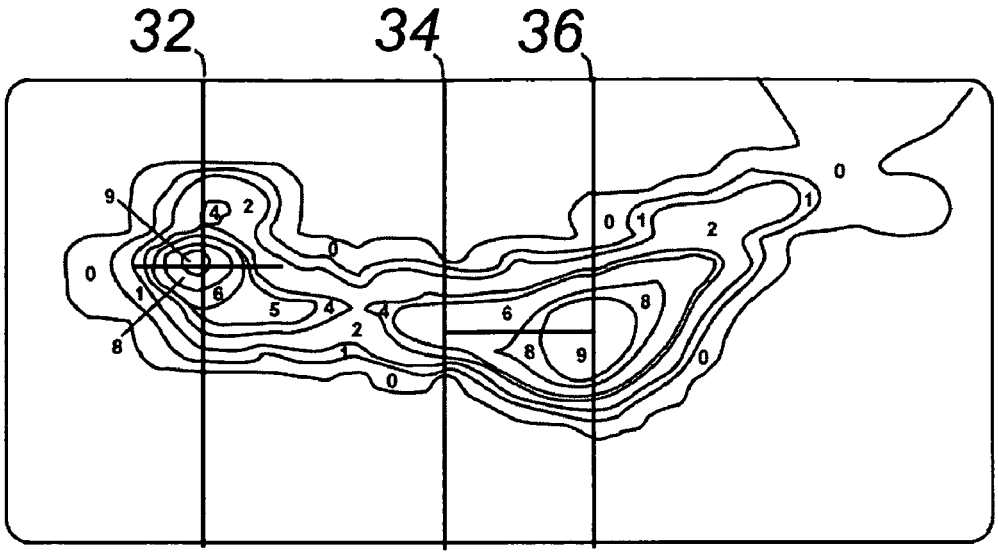
FIG. 11 is a pressure map showing pressure zones produced by a side sleeper using only a conventional fiber filled pillow under their head, where the firmness rating of the mattress is given a rating of 75 (medium firm)
Figure 12:
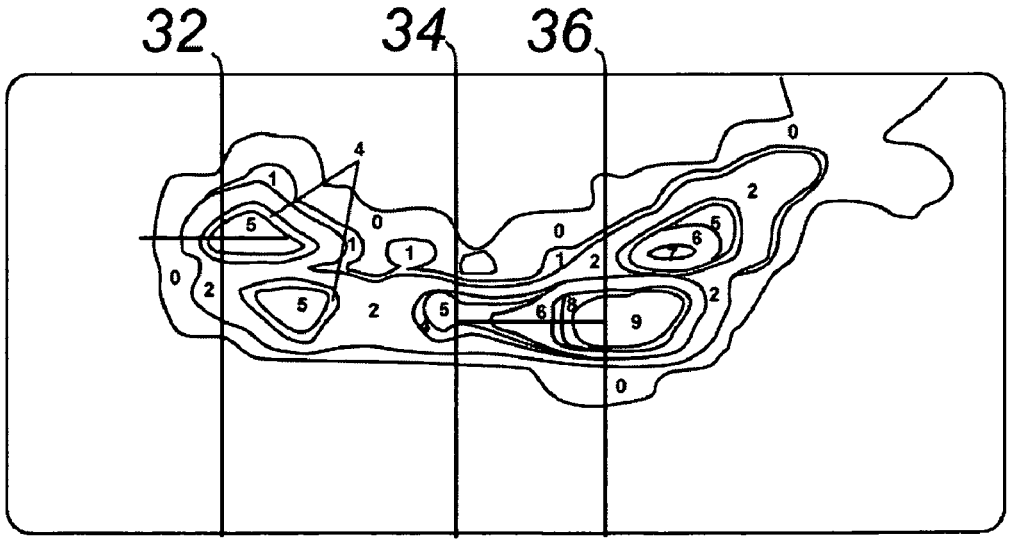
FIG. 12 is a pressure map showing changes in the pressure zones produced by a side sleeper using a conventional fiber filled pillow under their head and the present invention under the axilla and upper rib cage area, where the firmness rating of the mattress is given a rating of 75 (medium firm)
Figure 13:
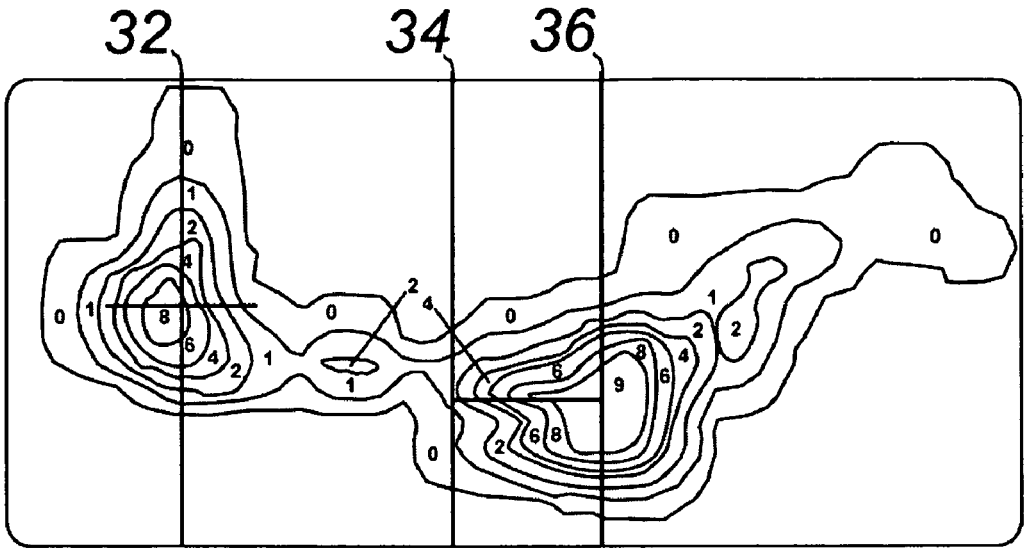
FIG. 13 is a pressure map showing pressure zones produced by a side sleeper using only a conventional fiber filled pillow under their head, where the firmness rating of the mattress is given a rating of 100 (firm)
Figure 14:
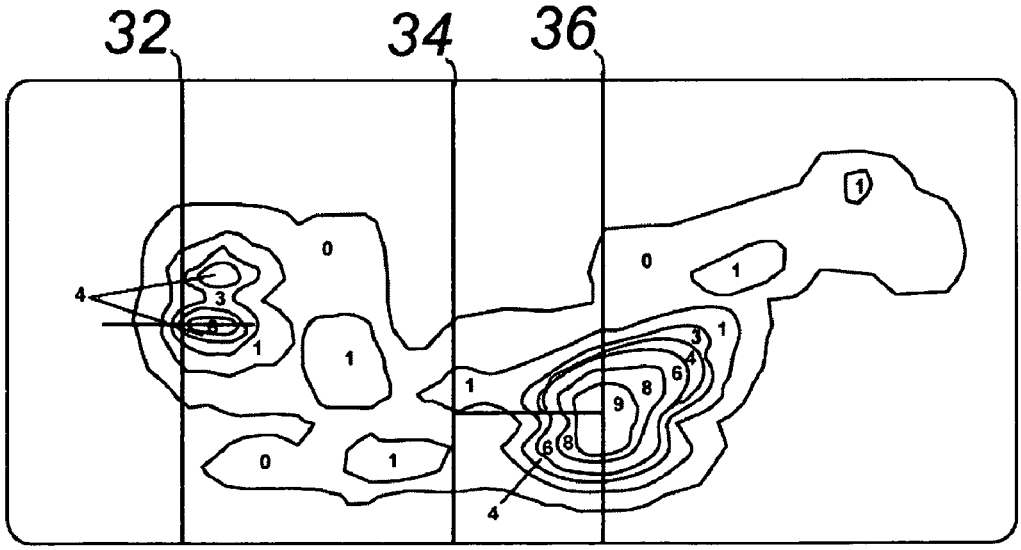
FIG. 14 is a pressure map showing changes in the pressure zones produced by a side sleeper using a conventional fiber filled pillow under their head and the present invention under the axilla and upper rib cage area, where the firmness rating of the mattress is given a rating of 100 (firm)

Referring generally to FIGS. 9-14; a series of pressure maps are shown having been translated from a full body length Xsensor® Pressure Mapping System from XSENSOR Technology Corporation of Calgary, Canada, paired with a Select Comfort® Mattress capable of varying the firmness of the mattress, where the pressure mapping data has been extrapolated from a color gradient scale to numeric scale, with 0 designating the lowest relative pressure and 9 designating the highest relative pressure. FIG. 9, FIG. 11 and FIG. 13 are pressure maps where a side sleeping test subject is using only a conventional FFP under the head and neck region, and the figures representing a relative mattress firmnesses of 50 (medium), 75 (medium firm) and 100 (firm) respectively. FIG. 10, FIG. 12 and FIG. 14 show the side sleeping test subject using a conventional FFP pillow under the head combined with a preferred embodiment according to the present invention placed under the axilla and upper thoracic region of the spine, where the mattress firmness corresponds to firmness ratings of 50, 75 and 100 respectively. Guidelines 32 with the crossbar, mark the position of the test subject's shoulder. Guidelines 34 and 36 with the crossbar, mark the position and orientation of the test subject's lumbar spine. The side sleeper pillow used for the pressure mapping the test had an uppermost layer of visco-elastic memory foam with a density of 3 lbs with an ILD of 9 Lbs, a middle layer of polyurethane foam having a density of 1.8 lbs with an ILD of 15, and a base layer of polyurethane foam having a density of 2.7 lbs with an ILD rating of 26.

Comparing FIG. 9 and FIG. 10, a retreat of pressure areas corresponding to a rating of 6 in the upper lumbar region is shown being replaced by relatively lower pressure areas corresponding to ratings 4 and 5 on the pressure scale. An area of pressure rating 7 has also retreated centering about the hip joint. A lessening of pressure about the shoulder region is also observed with an area of pressure rating 7 replaced with pressure areas corresponding to pressure rating of 5 and 4.

Comparing FIG. 11 and FIG. 12, a retreat of pressure areas corresponding to a 6 in the upper lumbar region is shown being replaced by relatively lower pressure areas corresponding to numbers 4 and 5 on the pressure scale. Examining the area representing the shoulder region, we see that areas of relatively high pressure 9 and 8, have been replaced by areas of relatively lower pressure 5 and 4.

Comparing FIG. 13 and FIG. 14, a retreat of pressure areas corresponding to 6,4 and 2 in the upper lumbar region is shown being replaced by relatively lower pressure areas corresponding to number 1 on the pressure scale. Examining the area representing the shoulder region, we see that areas of relatively high pressure 8 and 6, have been replaced by areas of relatively lower pressure 4, 3 and 1.

Regardless of the firmness rating of the mattress, a reduction of pressure centered on and surrounding the shoulder and upper lumbar regions was observed when the side sleeper pillow was used as an adjunct to a conventional fiber-filled pillow positioned under the sleeper's head. The pressure maps show substantial benefits in the shoulder area and low back area with a significant reduction in load bearing by the shoulder joint/arm and low back areas. The pressure map also shows a redistribution of load bearing to the upper rib cage area, which is desirable.

While the invention has been described by the embodiments given, it is not intended to limit the scope of the invention to the particular form set forth, but on the contrary, it is intended to cover such alternatives, modifications, and equivalents as may be included within the spirit and scope of the invention as defined by the appended claims.

I claim:

1. A pillow for side sleeping having a top, a bottom and sides, and four ends for the reduction of lower lumbar and cervical pain comprising:

a series of foam layers having an uppermost layer, a middle layer and a base layer, each layer laminated to an adjacent layer and each layer having a different ILD rating; and, a top surface further comprising:

i) an uppermost region built up from the series of foam layers defining a level plateau for positioning under, and at least partially within the axilla, and bounded on three sides by the ends of the pillow; and, ii) a lowermost substantially planar region of lesser thickness than the plateau built up from the series of foam layers, and bounded on three sides by the ends of the pillow; and, iii) a middle region adjacent the uppermost region and abutting a side of the lowermost region, defined by a declination from the plateau transitioning to the region of lesser thickness; and, the entire pillow sized for placement beneath a side-sleeper wherein at least two ends are bounded by the side-sleeper's pelvis and shoulder for overall alignment of the spinal column and wherein the lowermost region resides under the ribcage.

2. The pillow according to claim 1, in which an uppermost foam layer is visco-elastic foam.

3. The pillow according to claim 1, in which the middle foam layer has a greater ILD rating than the uppermost foam layer.

4. The pillow according to claim 1, in which the base foam layer has a greater ILD rating than the middle foam layer.

5. The pillow according to claim 1, in which the uppermost foam layer has a density between 2 lbs and 5.5 lbs.

6. The pillow according to claim 1, in which the middle foam layer has a density between 1.8 lbs and 3 lbs.

7. The pillow according to claim 1, in which the base foam layer has a density between 1.8 lbs and 4 lbs.

8. The pillow according to claim 1, in which the uppermost foam layer has a density between 2.5 lbs and 4 lbs.

9. The pillow according to claim 1, in which the middle foam layer has a density between 1.8 lbs and 2.5 lbs.

10. The pillow according to claim 1, in which the base foam layer has a density between 2.5 lbs and 3 lbs.

11. The pillow according to claim 1, in which the uppermost foam layer has an ILD rating ranging of between 8 lbs and 13 lbs.

12. The pillow according to claim 1, in which the middle foam layer has an ILD rating ranging between 14 lbs and 20 lbs.

13. The pillow according to claim 1, in which the base foam layer has an ILD rating ranging between 21 lbs and 31 lbs.

14. The pillow according to claim 1, in which the uppermost foam layer most preferably has an ILD rating of 9 lbs.

15. The pillow according to claim 1, in which the middle foam layer most preferably has an ILD rating of 15 lbs.

16. The pillow according to claim 1, in which the base foam layer most preferably has an ILD rating of 26 lbs.

17. The pillow according to claim 1, in which the middle and base foam layers are of polyurethane.

18. The pillow according to claim 1, in which the base layer has a greater ILD rating than the middle layer and the middle layer has a greater ILD rating than the uppermost layer.

19. The pillow according to claim 1, in which the uppermost foam layer is visco-elastic foam.

* * * * *